US008651540B2

(12) United States Patent
Daniel

(10) Patent No.: US 8,651,540 B2
(45) Date of Patent: Feb. 18, 2014

(54) LIFTING APPARATUS AND METHOD OF USE

(75) Inventor: Timothy E. Daniel, Carlock, IL (US)

(73) Assignee: Daniel Manufacturing, Inc., Carlock, IL (US)

( * ) Notice: Subject to any disclaimer, the term of this patent is extended or adjusted under 35 U.S.C. 154(b) by 0 days.

(21) Appl. No.: 13/449,124

(22) Filed: Apr. 17, 2012

(65) Prior Publication Data

US 2013/0270849 A1 Oct. 17, 2013

(51) Int. Cl.
*B66C 1/54* (2006.01)

(52) U.S. Cl.
USPC ..... 294/97; 294/95; 294/117

(58) Field of Classification Search
USPC ..... 294/97, 95, 96, 93, 94, 902, 116, 117
See application file for complete search history.

(56) References Cited

U.S. PATENT DOCUMENTS 764,281 A * 7/1904 Duncan ..... 294/89
2,404,775 A * 7/1946 Ehmann ..... 294/89
2,563,164 A * 8/1951 Fletcher ..... 294/89
4,261,548 A 4/1981 Kaderabek
4,300,382 A * 11/1981 Meek ..... 294/97
4,304,432 A * 12/1981 Silva ..... 294/93
4,400,959 A * 8/1983 Reigner et al. ..... 72/112
4,506,924 A 3/1985 Nieder
4,575,144 A * 3/1986 Silva et al. ..... 294/97
7,575,262 B2 * 8/2009 Alba et al. ..... 294/89
7,669,905 B1 * 3/2010 Kondo ..... 294/97
2011/0262263 A1 10/2011 Comerford et al.

* cited by examiner

*Primary Examiner* — Paul T Chin
(74) *Attorney, Agent, or Firm* — Husch Blackwell LLP

(57) ABSTRACT

The present invention is a lifting apparatus that includes a master wedge bar, a slave wedge bar, a cam lug and a handle. The master wedge bar and slave wedge bar are configured to be placed in a drilled core in an object to be lifted. The cam lug is pivotally coupled to the master wedge bar and drivingly engages with the slave wedge bar such that upward force applied to a lift end of the cam lug drives the slave wedge downward. The master wedge bar and the slave wedge bar generate an outward force upon the core wall of the object upon the downward movement of the slave wedge bar relative to the master wedge bar such that the apparatus engages the core wall and secures itself in it by friction. A handle is configured to disengage the apparatus from the core wall when lifted upward.

16 Claims, 3 Drawing Sheets

LIFTING APPARATUS AND METHOD OF USE

CROSS-REFERENCE TO RELATED APPLICATIONS

None.

BACKGROUND OF THE INVENTION

1. Field of the Invention

The present invention is in the field of construction equipment.

2. Related Art

During construction projects, a contractor must often remove a section, slab or block of concrete or rock from the middle of a large floor slab, roadway, or similar concrete structure. Typically, the contractor will use a diamond saw to cut out and define the perimeter of the portion to be removed. The portion to be removed often does not have any raised or exposed edges that can be grasped in order to manipulate and/or remove the portion. Traditionally, contractors would turn to one of a few known techniques to remove the material within the defined perimeter under these conditions.

The contractor may break up the piece with a jack hammer or slab breaker and scoop it out in small pieces, if keeping the section intact is not needed. This process is slow and very labor intensive, resulting in a relatively high removal cost. To keep the section intact requires installing anchor bolts that have lift eyes. Rigging is attached to the lift eyes so the slab can be lifted out and moved by a skid-steer or other piece of hydraulic construction equipment. The anchors are expensive, are not reusable, require special tools to install, and protrude from the surface creating handling issues with removed section pieces. Another technique is to use a vacuum lifting device, but these have a very high equipment cost and are delicate and bulky.

Thus, there is a need in the art for a lifting apparatus that is easy to use, allows a contractor to remove the entire slab portion at once, is economical, and is reusable.

SUMMARY OF THE INVENTION

The present invention is directed to a lifting apparatus that can be used to lift a section, slab, block, boulder, or large piece of concrete or other like objects. The lifting apparatus comprises a master wedge bar, a slave wedge bar, a cam lug, and a handle. The cam lug has a lift end and a cam end, and the cam lug is pivotably connected to the master wedge bar between the lift end and the cam end. As such, when an upward force is applied to the lift end of the cam lug, the cam end of the cam lug is displaced downward. The cam end of the cam lug is drivingly engaged with the slave wedge bar such that when the cam portion is displaced downward, it drives the slave wedge bar downward. The master wedge bar and the slave wedge bar are configured with planar faces that engage each other wherein the planar faces are configured such that downward movements of the slave wedge bar relative to the master wedge bar causes the slave wedge bar to displace outward due to a wedge mechanism implemented into configuration of the planar faces of the wedge bars.

Further, a handle is operably connected to the end of the cam portion of the cam lug such that an upward force applied to the handle applies an upward force to the slave wedge bar thereby causing it to displace upwardly and inwardly and thereby disengage the wedge mechanism.

A contractor will drill a core into the section, slab, block, boulder, or large chunk at one or more points in order to ensure the load will be balanced upon lifting. The contractor will insert the lifting apparatus of the present invention into the core, hook the lift end of the cam lug up to a piece of construction equipment and begin to apply an upward lifting force upon the lift end of the lifting apparatus of the present invention. This upward force is levered into a downward force about pivot point of the cam lug. The downward force applied to the slave wedge bar by the cam portion of the cam lug causes the slave wedge to displace downward. The wedge-interface between the master wedge bar and the slave wedge bar causes the slave wedge bar to displace outwardly, thereby applying a force substantially normal to the wall of the core. Thus, the heavier an object to be lifted is, the more outward force is applied to the wall of the core thereby increasing the friction between the elements in a direct proportionality to the weight of the object. Thus, the apparatus of the present invention automatically provides increased frictional force necessary for the lifting apparatus to securely grasp the section, slab, etc. for heavier objects so that the object may be lifted and removed.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and, therefore, the description is not to be taken in a limiting sense and shall not limit the scope of equivalents to which such claims are entitled.

Figure 1:
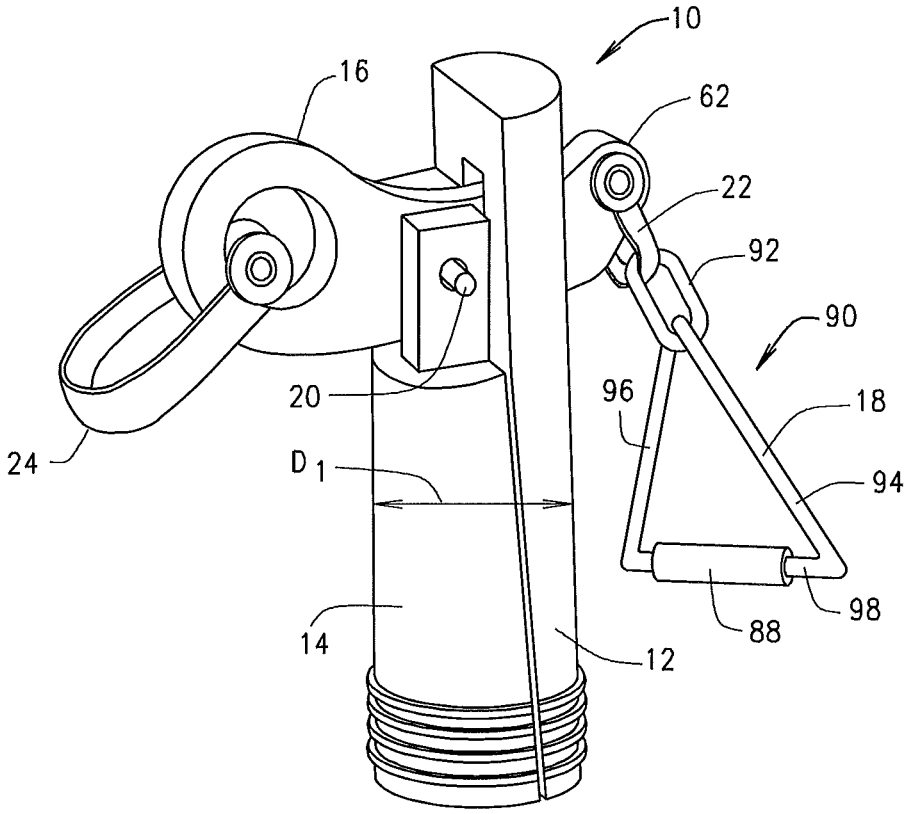
FIG. 1 is a perspective view of one embodiment of the lifting apparatus in accordance with the teachings of the present invention.

As illustrated in FIG. 1, the present invention is directed toward a lifting apparatus 10 including a slave wedge bar 12, a master wedge bar 14, a cam lug 16, and a release handle 18. Lifting apparatus 10 may also include a cam lug pin 20 to pivotally couple cam lug 16 to the master wedge bar, a release handle shackle 22 to couple the handle 18 to the cam lug 16, and a main lift shackle 24 coupled to the cam lug 16 to be attached to rigging to apply a lift force to lifting apparatus 10.

Figure 2:
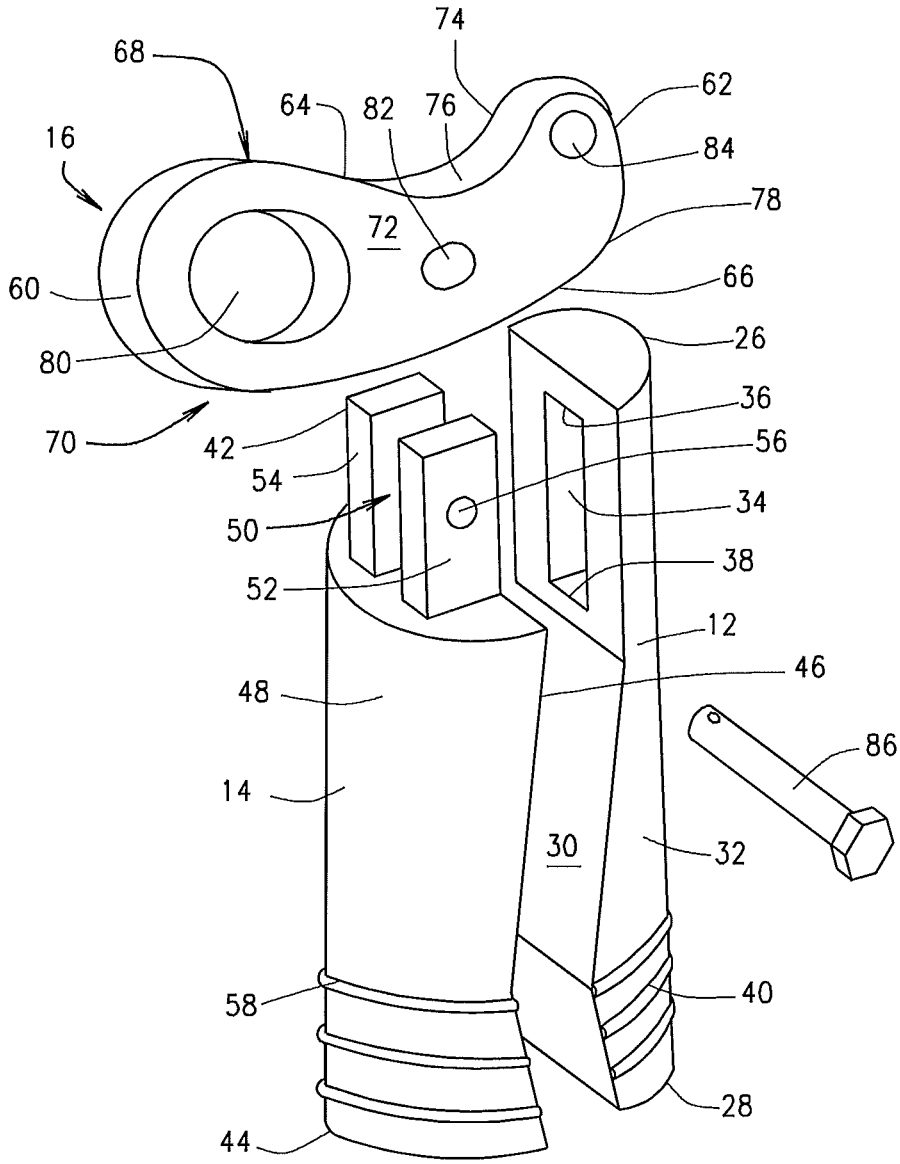
FIG. 2 is an exploded perspective view of the components of the embodiment of the lifting apparatus in accordance with the teachings of the present invention.

As best shown in FIG. 2, slave wedge bar 12 includes a first end 26 and a second end 28 wherein the distance between first end 26 and second end 28 generally defines a length of slave wedge bar 12. One embodiment of the slave wedge bar 12 has a substantially semi-circular cross-section that results in slave wedge bar having a planar face 30 and an arcuate outer surface 32. However, slave wedge bar may have any cross-sectional shape, including triangular, square, rectangular, pentagon, hexagon, septagon, octagon, or any other polygon may be used that provides the adequate surface area interaction with the surface acted upon. As shown in FIG. 2, one embodiment of planar face 30 may include a convex or outward projecting "V" shaped profile. However, another embodiment shown in FIG. 1 includes planar face 30 being a linear plane having a tapered slope wherein the thickness of the slave wedge bar between planar face 30 and the apex of the arcuate surface decreases from first end 26 to second end 28

Slave wedge bar 12 also includes a slot 34 in a proximate portion of its first end 26. Slot 34 includes a top side 36 and a bottom side 38 that define a slot length therebetween. One embodiment of slave wedge bar 12 further includes one or more circumscribing ribs 40 that are configured to engage the acted upon surface and provide a better grip against it.

FIG. 2 illustrates master wedge bar 14 having a first end 42 and a second end 44. One embodiment of master wedge bar 14 has a substantially semi-circular cross-section that results in slave wedge bar having a planar face 46 and an arcuate outer surface 48. However, master wedge bar 14 may have any cross-sectional shape, including triangular, square, rectangular, pentagon, hexagon, septagon, octagon, or any other polygon may be used that provides the adequate surface area interaction with the surface acted upon. As shown in FIG. 2, one embodiment of planar face 48 may include a concave or inward projecting "V" shaped profile that is complementary to planar face 30 of slave wedge bar 12. However, another embodiment shown in FIG. 1 includes planar face 48 being a linear plane having a tapered slope wherein the thickness of the master wedge bar between planar face 48 and the apex of the arcuate surface increases from first end 42 to second end 44. The tapered slope of planar face 48 in FIG. 1 is generally complementary to the tapered slope of planar face 30 as shown.

Master wedge bar 14 also includes a fork 50 comprised of a first fork leg 52 and a second fork leg 54 with a space therebetween. Master wedge bar 12 further includes a pin aperture 56 through both first fork leg 52 and second fork leg 54 wherein pin aperture 56 is configured to receive a pin or other fastener therethough. One embodiment of master wedge bar 14 further includes a one or more circumscribing ribs 58 that are configured to engage the acted upon surface and provide a better grip against same.

As shown in FIG. 2, cam lug 16 includes a lift end 60, a cam end 62, a top surface 64, a bottom surface 66, a top edge 68, a bottom edge 70, a first side 72 and a second side 74. Top edge 64 has a concave portion 76 between lift end 60 and cam end 62. A portion of bottom edge 70 may be substantially linear until the bottom edge convex portion 78 proximate the cam end portion 62 as shown. As further shown in FIG. 2, cam lug 16 includes a lift aperture 80 proximate to the lift end 60, a pin aperture 82 between lift end 60 and cam end 62, and a handle aperture 84 proximate to the cam end 62. As further shown in FIGS. 1 and 2, cam lug 16 is configured to be positioned between first fork leg 52 and second fork leg 54 and pivot pin 86 is inserted through pin aperture 56 of fork 50 and pin aperture 82 of cam lug 16 to pivotally couple cam lug 16 to master wedge bar 14.

Lifting apparatus 10 may include release handle 18 including a hand grip portion 88 and a handle structure 90. The handle 18 may be coupled to the cam 16 by a cam connection member 92. As shown in FIG. 1, one embodiment of the present invention includes handle structure 90 comprising a triangular shape and including a first leg 94, a second leg 96, and a handle leg 98 wherein grip portion 88 is a tubular-shaped member surrounding handle leg 98. Handle 18 may be any handle shape now known or hereafter developed that can be gripped by a user and has a structure sufficient to transfer an upward force applied by a user to the cam end 62 of the cam lug 16. Another embodiment may include the handle 18 simply being a rope on which a user may pull upward. A person of skill in the art would appreciate that there are numerous handle configurations known in the art, all of which are within the scope of the present invention. As further shown in FIG. 1, handle 18 may be removably coupled to cam lug 16 by handle shackle 22 wherein a portion of handle shackle 22 is inserted through handle aperture 84 of cam lug 16.

All the components of the lifting apparatus can be constructed from industrial metals such as iron, steel, aluminum, brass, or titanium; a variety of rigid high strength polymers as now known or hereafter developed; carbon fiber; or any other material now known or hereafter developed. However, metals are preferred as their ductility allows any weakness or pending failure to be observed prior to actual failure.

Figure 3:
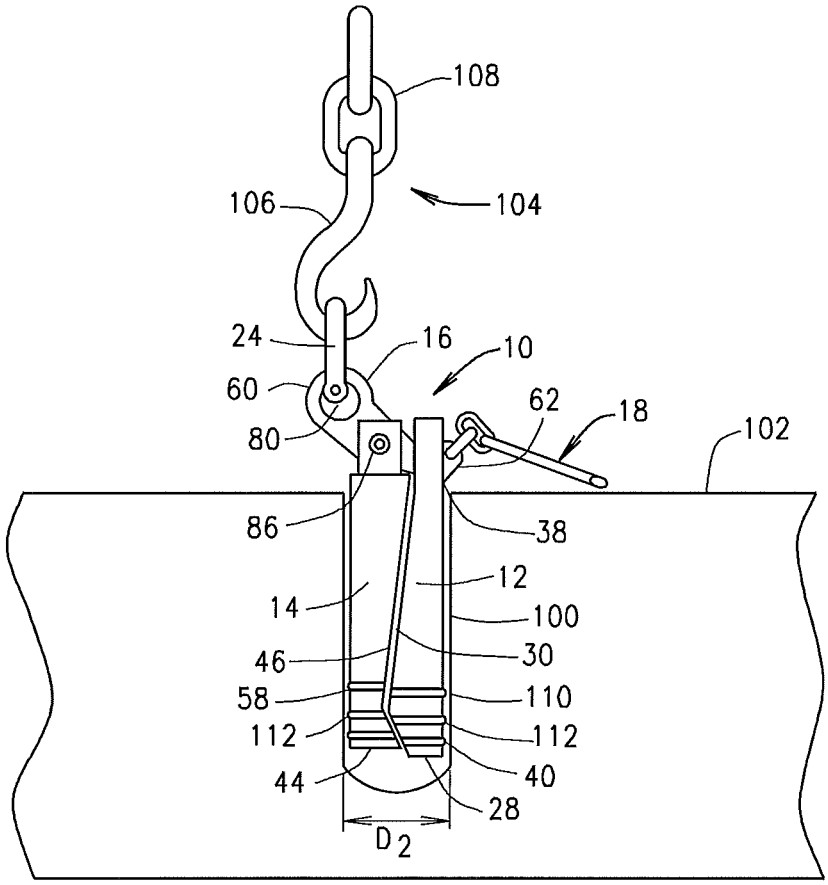
FIG. 3 is a sectional side view of the embodiment of the embodiment of the lifting apparatus in FIG. 2 inserted into a core cut into an object to be lifted.

In use, the lifting apparatus 10 of the present invention may be used to lift any number of heavy objects, including, but not limited to a section, slab, block, or large chunk of concrete or rock out of the middle of a large floor slab, roadway, rock formation, or other concrete or rock structure or deposit. As shown in FIG. 3, a core 100 having a diameter $D_2$ is drilled into or through an object 102 to be lifted. As shown in FIG. 1, when slave wedge bar 12 and master wedge bar are aligned, the resulting diameter of the apparatus is diameter $D_1$ as shown. The core diameter $D_2$ will be slightly greater than diameter $D_1$ allowing the slave wedge bar 12 and master wedge bar 14 to be inserted into the core 100 as shown in FIG. 3.

The lift end 60 of cam lug 16 is coupled to rigging 104. One embodiment includes a lift shackle 24 being coupled to the cam lug 16 by being secured through the lift aperture 80 as shown. Rigging 104 may include a hook 106 that is at the end of a chain 108 as shown. Rigging 104 may be connected to hydraulic or mechanical lifting machinery such as a crane, a skid-steer, a backhoe, a trackhoe, or any other industrial lifting machine or device. The hook 106 is inserted through lift shackle 24 as shown.

When an upward force is applied to rigging 104, the lift end 60 of cam lug 16 is displaced upwardly. The lifting apparatus 10 will not be pulled out of core 100 upon the application of the upward force by rigging 104 because the upward force is applied eccentrically to the center of mass of the lift apparatus 10, thus rotating the master wedge bar 14 in a first direction against a first side of the core wall 110 to generate a friction force against core wall 110, keeping apparatus 10 within the core 100. With lifting apparatus 10 secure within core 100, cam lug 16 pivots about pivot pin 86 thereby applying a downward force upon bottom side 38 of slot 34 of slave wedge bar 12. The slave wedge bar 12 is thereby displaced downwardly relative to master wedge bar 14 as shown in FIG. 3. The wedged configuration of the planar surface 30 and planar surface 46 result in master wedge bar 14 and slave wedge bar 12 being concurrently outwardly displaced relative to one another, and may also be downwardly displaced. The outward displacement of slave wedge bar 12 in a second direction continues until the slave wedge bar 12 engages a second slide of core wall 110 as shown in FIG. 3.

The weight of object 102 being supported by rigging 104 continually applies an upward force on lift end 60, providing a continuous downward force upon slave wedge bar 12. The outward component of the force generated by the wedged planar surfaces 30 and 46 creates and maintains a force substantially normal to an interface 112 between the arcuate surfaces 32 and 48 and core wall 110. The constant force substantially normal to interface 112 increases the frictional resistance thereby allowing the lifting machine to lift and remove the object due to lifting apparatus 10 sufficiently gripping object 102. The frictional resistance force is proportional to the normal force applied by the wedge bars 12 and 14. The outward force against the core wall 110 applied by lifting apparatus 10 is directly proportional to the weight of the object. The magnitude of the horizontal force can be adjusted by altering the angle of incline of the planar surfaces 30 and 46 such that lifting apparatus 10 may be customized for the coefficient of friction for the material of the master and slave wedge bars 14 and 12 as well as the material comprising the object. As further shown in FIG. 3, ribs 40 and 58 may be present on second ends 28 and 44 of the wedge bars 12 and 14 to increase the friction and/or concentrate the horizontal force applied to the core wall 110.

To remove lifting apparatus 10 from core 100, a user will grasp handle 18 and pull upwardly. An upward force applied to handle 18 simultaneously applies an upward force to cam end 62 of cam lug 16. The upward force upwardly displaces slave wedge arm 12 which significantly reduces or fully eliminates the outward horizontal force and, thus, the frictional force resisting the removal of lifting apparatus 10 from core 100.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

I claim:

1. A lifting apparatus comprising:

a master wedge bar having a first end and a second end;

a cam lug having a lifting end and a cam end wherein said cam lug is pivotably coupled to said first end of master wedge bar between said lifting end and said cam end;

a slave wedge bar having a first end and a second end, said cam lug being drivingly engaged with said slave wedge bar; and wherein said master wedge bar and said slave wedge bar are engaged at a surface interface and wherein said surface interface is configured to displace said slave wedge bar outwardly upon a downward displacement of said slave wedge bar relative to said master wedge bar.

2. The lifting apparatus of claim 1 further comprising a handle coupled to said cam end of said cam lug.

3. The lifting apparatus of claim 2 wherein said cam lug is configured to engage said slave wedge bar upon an upward force being applied to said handle.

4. The lifting apparatus of claim 1 wherein said surface interface is sloped and planar.

5. The lifting apparatus of claim 1 wherein said surface interface includes a "V" shape.

6. The lifting apparatus of claim 1 wherein said master wedge bar includes a first fork member and a second fork member defining a space therebetween and wherein said cam member is between said first and second fork member.

7. The lifting apparatus of claim 6 wherein said first fork member, said second fork member, and said cam lug include a pin aperture therethrough and a pivot pin is inserted through said pin apertures.

8. The lifting apparatus of claim 1 wherein said master wedge bar and said slave wedge bar include annular ribs proximate said second ends.

9. The lifting apparatus of claim 1 further comprising a lifting shackle operably connected to said cam lug.

10. A method for lifting an object comprising;

drilling a core in said object;

inserting a lifting apparatus into said core, said lifting apparatus comprising a a master wedge bar having a first end and a second end;

a cam lug having a lifting end and a cam end wherein said cam lug is pivotably coupled to said first end of said master wedge bar between said lifting end and said cam end;

a slave wedge bar having a first end and a second end, said cam lug being drivingly engaged with said slave wedge bar; and wherein said master wedge bar and said slave wedge bar are engaged at a surface interface and wherein said surface interface is configured to displace said slave wedge bar outwardly upon a downward displacement of said slave wedge bar relative to said master wedge bar;

connecting said lifting end of said cam lug to a rigging; and wedging said master wedge bar and said slave wedge bar against a wall of said core by applying an upward lifting force to said lifting end of said cam lug.

11. The method of claim 10 wherein said lifting apparatus further comprises a handle operably connected to cam end of cam lug.

12. The method of claim 11 further comprising lifting said handle to disengage said master wedge bar and said slave wedge bar from said wall of said core.

13. The method of claim 12 further comprising removing said lifting apparatus from said core.

14. A lifting apparatus comprising:

a master wedge bar having a first end and a second end;

a cam lug having a lifting end and a cam end wherein said cam lug is pivotably coupled to said first end of master wedge bar between said lifting end and said cam end;

a slave wedge bar having a first end and a second end, said cam lug being drivingly engaged with said slave wedge bar;

wherein said master wedge bar and said slave wedge bar are engaged at a surface interface and wherein said surface interface is configured to displace said slave wedge bar outwardly upon a downward displacement of said slave wedge bar relative to said master wedge bar; and wherein said master wedge bar includes a first fork member and a second fork member defining a space therebetween and wherein said cam member is between said first and second fork member.

15. The lifting apparatus of claim 14 wherein said first fork member, said second fork member, and said cam lug include a pin aperture therethrough and a pivot pin is inserted through said pin apertures.

16. A lifting apparatus comprising:

a master wedge bar having a first end and a second end;

a cam lug having a lifting end and a cam end wherein said cam lug is pivotably coupled to said first end of master wedge bar between said lifting end and said cam end;

a slave wedge bar having a first end and a second end, said cam lug being drivingly engaged with said slave wedge bar;

wherein when an upward force is applied to the cam lug on the lifting end, a downward force would be applied from the cam end on to the slave wedge bar; and wherein said master wedge bar and said slave wedge bar are engaged at a surface interface and wherein said surface interface is configured to displace said slave wedge bar outwardly upon a downward displacement of said slave wedge bar relative to said master wedge bar.

* * * * *